United States Patent [19]

Kohner

[11] Patent Number: 4,591,345

[45] Date of Patent: May 27, 1986

[54] CONFINED ANIMATION FIGURE TOY

[75] Inventor: Michael Kohner, Parsippany, N.J.

[73] Assignee: The Michael Kohner Corp., Parsippany, N.J.

[21] Appl. No.: 681,787

[22] Filed: Dec. 14, 1984

[51] Int. Cl.[4] ..... A63H 3/20

[52] U.S. Cl. ..... 446/361; 446/380

[58] Field of Search ..... 446/363, 362, 361, 359, 446/365, 380, 337, 331, 371

[56] References Cited

U.S. PATENT DOCUMENTS

| | | | |
|---|---|---|---|
| 1,463,032 | 7/1923 | Bantle | 446/331 |
| 1,537,293 | 5/1925 | Da Costa | 446/380 |
| 2,202,677 | 5/1940 | Usinskis | 446/362 X |
| 2,570,737 | 10/1951 | Whitcomb | 446/84 |
| 2,652,658 | 9/1953 | Barkey | 446/363 |
| 2,740,232 | 4/1956 | Handler et al. | 446/303 |
| 2,932,919 | 4/1960 | Evans | 446/84 |
| 3,178,852 | 4/1965 | Whitcomb | 446/337 X |

*Primary Examiner*—Mickey Yu

*Attorney, Agent, or Firm*—Kirschstein, Kirschstein, Ottinger & Israel

[57] ABSTRACT

A confined animation figure toy includes a housing which is at least partially transparent, and an animation figure confined in the interior of the housing. The animation figure is suspended from an elongated operating element which passes through the top part of the housing from the exterior of the housing to its interior and is connected at its end remote from the figure to an actuating element. The actuating element can be constructed as a ring for receiving a finger of the user, and the elongated element may be a string which is guided on the back wall of the housing in a guiding eyelet. In the alternative, the actuating element may be constructed as a spring-biased slide partially received in a channel of the bottom wall of the housing, or as a crank rotatably mounted at the back wall of the housing. It is also possible to provide more than one operating element, each such operating element being connected to a different part of the toy figure and being independently displaceable. The housing is so constructed that the figure is accommodated therein with a limited freedom of movement, so that the various parts of the figure strike, and bounce off from, the walls of the housing. The various parts of the figure are connected to one another for displacement relative to one another, such as by flexible strings, so as to conduct seemingly independent movements.

1 Claim, 6 Drawing Figures

CONFINED ANIMATION FIGURE TOY

BACKGROUND OF THE INVENTION

The present invention relates to animation toys in general, and more particularly to an animation figure which is accommodated in the interior of a housing during the use thereof.

It is well known that children, especially young ones, rejoice in playing with toys which simulate activities, that is, which resemble living beings not only in appearance, which may be stylized, but also, and more importantly, in conducting various movements. This explains the popularity of hand puppets, marionettes and similar toys. However, experience with the toys of this kind has shown that children very soon grow tired of them, especially since the mechanics of movement of such toys are readily apparent from the predictable movements thereof. To avoid this drawback, it has been already proposed, for instance, in U.S. Pat. Nos. 955,407; 1,213,076; 1,219,099; 1,898,735; 2,100,486; 2,242,611; 2,334,212; 2,596,866; 3,060,632; and 3,063,193 to mount respective figures in the interior of a housing or casing or on a support, and to impart movement to such figures by means of either a movable member which extends from the rear to the torso of the figure, or a movable platform on which the legs of the figure rest. However, even these solutions have not achieved any noted success, which is attributed to the fact that, even though attempts are made to conceal the presence of the supporting and moving means, such means are still rather clearly detectable by either direct observation thereof, or by perceiving the movements of the platform. This, of course, is a pronounced disadvantage since it detracts from the appeal of such conventional toys.

SUMMARY OF THE INVENTION

Accordingly, it is a general object of the present invention to avoid the disadvantages of the prior art.

More particularly, it is an object of the present invention to provide an animation toy which does not possess the disadvantages of the conventional toys of this type.

Still another object of the present invention is so to construct the animation toy of the type here under consideration as to keep the means used to impart animation to an animation figure of the toy as inconspicuous as possible.

It is yet another object of the present invention so to design the toy of the above type as to give a verisimilar simulation of unpredictable voluntary movements on the part of the figure.

A concomitant object of the present invention is to develop an animation toy of the above type which is simple in construction, inexpensive to manufacture, easy to use, and reliable in operation nevertheless.

In pursuance of these objects and others which will become apparent hereafter, one feature of the present invention resides in an animation toy which comprises a housing including a plurality of walls collectively bounding an internal chamber, at least a part of at least one of the walls being transparent to enable a user of the toy to observe the interior of the housing and its contents; at least one elongated operating element mounted on the housing for movement at least in its longitudinal direction and having a suspension portion extending into the internal chamber through the top one of the walls of the housing as considered in the position of use of the toy, and an actuating portion located at the exterior of the housing; and an animation figure accommodated in the internal chamber of the housing and having a plurality of connected parts at least one of which is elastically displaceable with respect to another, the figure being suspended from the suspension portion of the operating element for movement in response to the movement of the latter between a rest position in which the figure assumes a substantially erect position and a plurality of animated positions with attendant elastic displacement of the one part with respect to the other part of the figure to simulate voluntary body movements. A particular advantage of this construction is that, since the very same operating element as that which holds the animation figure is being used to impart the movement thereto, and this element depends downwardly into the internal chamber of the housing, each movement of this operating element will result in a different kind of movement of the figure , depending in a seemingly unpredictable manner not only on the extent of the displacement of the operating element, but also on the velocity and acceleration of such displacement and on other factors, such as the exact position of the various parts of the figure. Hence, the resemblance of voluntary, as opposed to forced or mechanical, movements on the part of the figure is improved, particularly if the operating element is made to visually disappear, for instance, by making the same of a transparent material. This effect is further enhanced when, in accordance with a currently preferred aspect of the present invention, the internal chamber of the housing is so dimensioned that during the movement of the animation figure into the animated positions thereof, at least one of the parts of the animation figure strikes the housing to bounce off therefrom in a verisimilar simulation of voluntary unpredictable body movements.

According to a facet of the present invention, the operating element is flexible, especially a string having one of its ends connected to the animation figure while its other end is situated at the exterior of the housing, there being further provided means for actuating the animation figure, such actuating means including an actuating element connected to the other end of the string. This actuating element can be constituted, in a very simple construction according to the present invention, by a ring dimensioned to receive a finger of a user of the animation toy. In this instance, it is particularly advantageous when there is further provided means for guiding the string at the exterior of the housing, such guiding means including an eyelet rigidly connected to the housing and serving as an abutment for the ring to hold the animation figure in its erect position.

According to another advantageous aspect of the present invention, the housing includes a channel, and the actuating element includes a slide partially received in the channel for sliding displacement longitudinally of the latter and entraining the other end of the string for joint movement therewith into and out of the channel. In this construction, there is advantageously further provided a spring accommodated in this channel and pressing the slide partially out of the channel.

It is, however, also advantageous when the actuating element includes a crank mounted for rotation with respect to the housing about a substantially horizontal axis. In this respect, it is further advantageous when there is further provided a music box, and when the crank is operative also for driving the music box to provide a musical accompaniment to the movements of the figure.

Advantageously, the one elongated operating element is connected to one of the parts of the animation figure, there being provided at least one additional elongated operating element similar to the one operating element and connected to a different one of the parts of the animation figure to provide for independent displacement of such parts.

The novel features which are considered as characteristic of the invention are set forth in particular in the appended claims. The improved animation toy itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
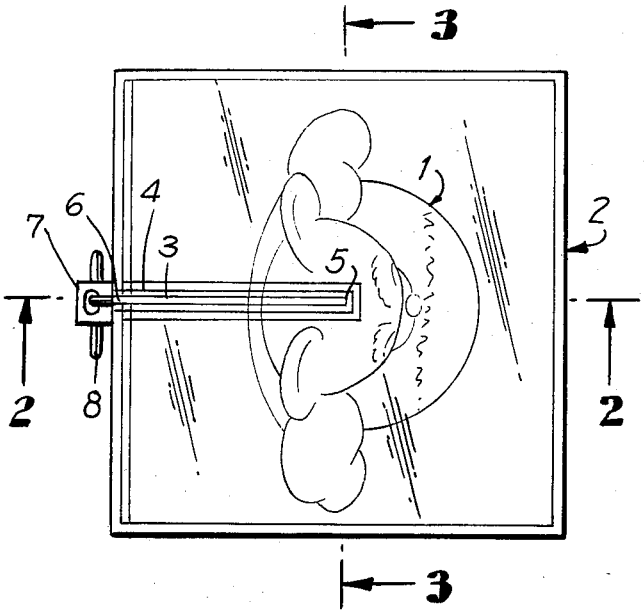
FIG. 1 is a top plan view of a confined animation figure toy according to the present invention.

Referring now to the drawing in detail, and first to FIG. 1 thereof, it may be seen that the reference numeral 1 has been used therein to identify a toy figure. The figure 1 shown in the drawing is a representation of a bear, but it will be appreciated that any other figure 1 could be employed instead. The figure 1 is accommodated in a hollow housing 2 and is suspended from a string or a similar elongated flexible element 3 which is guided on the housing 2 for movement at least in its longitudinal direction and extends between the interior and the exterior of the housing 2. The flexible element 3 is guided in a channel 4 of the housing 2 and passes through an orifice 5 into the interior of the housing 2 and though an opening 6 to the exterior of the housing 2. At the exterior of the housing 2, the flexible element 3 is guided in an eyelet 7 which is rigid with the housing 2, and is provided at its end remote from the figure 1 with a gripping ring 8.

Figure 2:
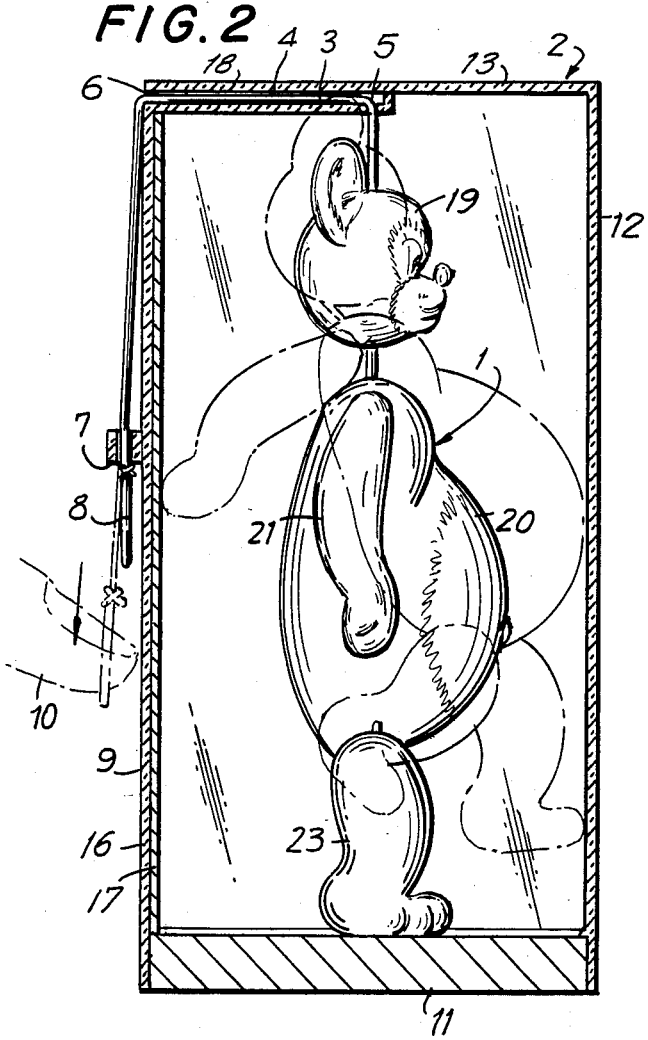
FIG. 2 is a sectional view taken along the line 2—2 of FIG. 1.

As shown in FIG. 2, the eyelet 7 is arranged substantially midway of the vertical dimension of a rear wall 9 of the housing 2, and the gripping ring 8 is situated just below and in abutment with the eyelet 7 in the rest condition of the toy which is illustrated in FIG. 2 in solid lines. The user of the toy can displace the gripping ring 8, and with it the flexible element 3 which is attached thereto, into a displaced condition shown in phantom lines, by inserting a finger 10 into the gripping ring 9 and pulling down on the latter.

The housing 2 further includes a base or bottom wall 11, preferably of an opaque material, a front wall 12 which is preferably transparent, a top wall 13 which is shown to be transparent but does not necessarily have to be, and two side walls which also may be but not necessarily are transparent. These side walls are particularly visible in FIG. 3 and are identified by the reference numerals 14 and 15, respectively. As shown in FIG. 2, the rear wall 9 includes an outer portion or layer 16 which is, in the illustrated construction, of one piece with the front, top and side walls 12, 13, 14, and 15 and, hence, transparent, and an inner portion or layer 17 which is opaque. It will be appreciated that at least one of the walls 12, 13, 14 and 15 will have to be transparent in order for the user to be able to observe the toy figure 1 therethrough. The channel 4 is provided in a thickened portion 18 of the top wall 13.

Figure 3:
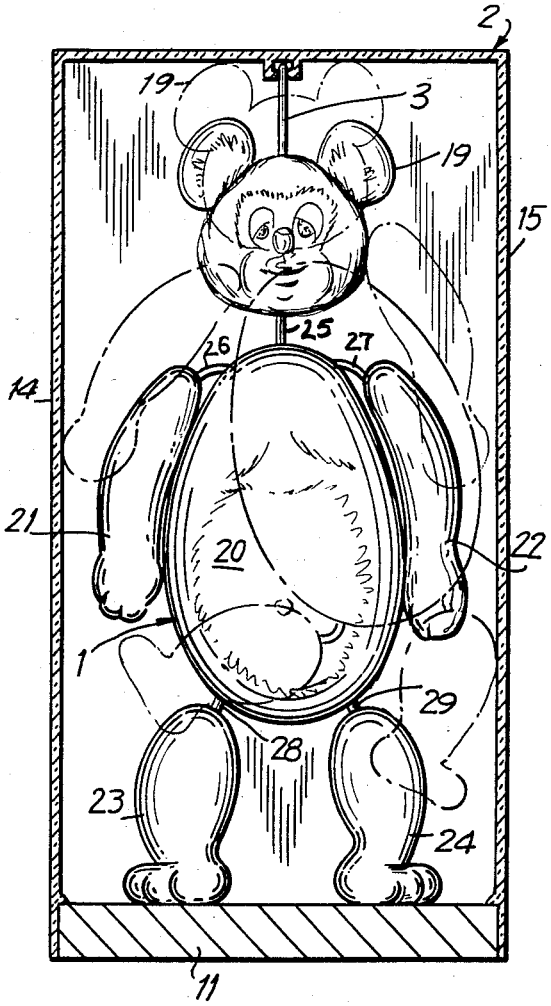
FIG. 3 is a sectional view taken along the line 3—3 of FIG. 1.

As a comparison of FIGS. 2 and 3 with one another will reveal, the figure 1 includes a head 19, a torso 20, two front legs or arms 21 and 22, and two hind legs 23 and 24. These parts 19 20, 21, 22, 23 and 24 are connected to one another, respectively, in such a manner that they are elastically or resiliently yieldable with respect to one another. As shown, this elastic yieldability is achieved in that the parts 19, 20, 21, 22, 23 and 24 are separate from one another and connected to one another by pieces 25, 26, 27, 28 and 29 of string or another flexible elongated formation. The head 19 is connected to that end of the flexible element 3 which emerges from the channel 4 into the interior of the housing. However, it will be appreciated that this end could be directly connected to the torso 20, if so desired, and merely pass, more or less loosely, through the head 19.

During use of the toy, the user observes the figure 1 through one of the transparent portions of the housing 2, especially through the front wall 12, or through one of the side walls 14 or 15. At the same time, concealed from the observer by the opaque wall 9, the same or another user pulls on the elongated element 3. As a result of this pulling action, which is followed by a releasing action, the end of the elongated element 3 which extends into the interior of the housing 2 conducts movements at least in the up and down directions (but more often than not also in the transverse directions). As a result of these movements of the elongated element 3, the figure 1 will move up and down (and/or transversely of the vertical directions), and the various individual parts 19 to 24 will simultaneously conduct movements relative to one another owing to their connections by the flexible pieces 25 to 29 and in response to the forces acting thereon. This is indicated in phantom lines in FIGS. 2 and 3 as an indication of one of the possible positions which the figure can assume when displaced by the flexible element 3 out of its generally standing position shown in solid lines in FIGS. 1 to 3. The movements of the parts 19 to 24 relative to one another then resemble animation, especially dancing movements, which brings joy and/or amusement to the observer of the toy.

It can also be seen particularly in FIGS. 2 and 3 that the walls 9, 12, 13, 14 and 15 are spaced from the figure 1 in the rest position of the latter which is shown in solid lines, but that these spacings are relatively small so that, when the figure 1 is displaced out of its rest position due to the pulling action of the string 3, for instance, into the position illustrated in phantom lines, the head 19, the torso 20, and/or one or more of the legs 21, 22, 23 and 24 will occassionally and seemingly unpredictably hit the respective walls 9, 11,12, 13, 14 and/or 15 and bounce off of the same, thus enhancing the appearance of voluntary dancing movements on the part of the figure 1.

Figure 4:
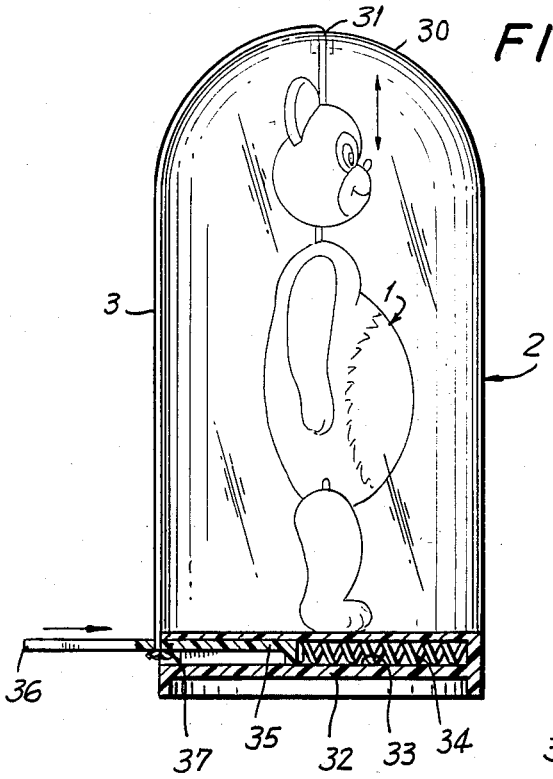
FIG. 4 is a view similar to that of FIG. 2 but showing a modified construction of the confined animation figure toy of the present invention.

Turning now to FIG. 4, it may be seen that it shows a modification which is based on the same principle as that described above, so that the same reference numerals as before have been used to identify corresponding parts. In this instance, the housing 2 is shown to have a generally cylindrical configuration with a dome-shaped top portion 30 which has a centrally situated through aperture 31 for the passage of the string 3 therethrough from the exterior to the interior of the housing 2. In this modified construction, the housing 2 has a bottom wall 32 which bounds a channel 33 that receives a spring 34 which may be a helical or coil spring as shown, and an actuator 35 which is preferably connected to the spring 34 or otherwise prevented from completely emerging out of the channel 33. The actuator or slide 35 has a gripping portion 36 which is accessibly situated at the exterior of the housing 2 in the rest position of the toy as shown in FIG. 4. The end of the string 3 which is remote from the figure 1 is attached to a portion 37 of the actuator 35 which is situated at the open end of the channel 33 in the rest position of the toy. However, the slide actuator 36 can be pushed against the force of the spring 34 into the channel 33, so that the portion 37 will be moved deeper into the channel 33 and with it the end of the string 3. Thus, the effective length of the string 3, that is, its length between the open end of the channel 33 and the toy figure 1, will be shortened and the figure 1 will thus be lifted. Then, upon release of the slide actuator 35, the spring 34 will become effective to resiliently displace the slide actuator 36 into its rest position, with attendant change in the effective length of the string 3 and consequent movements of the figure 1 in a manner similar to that discussed above.

Figure 5:
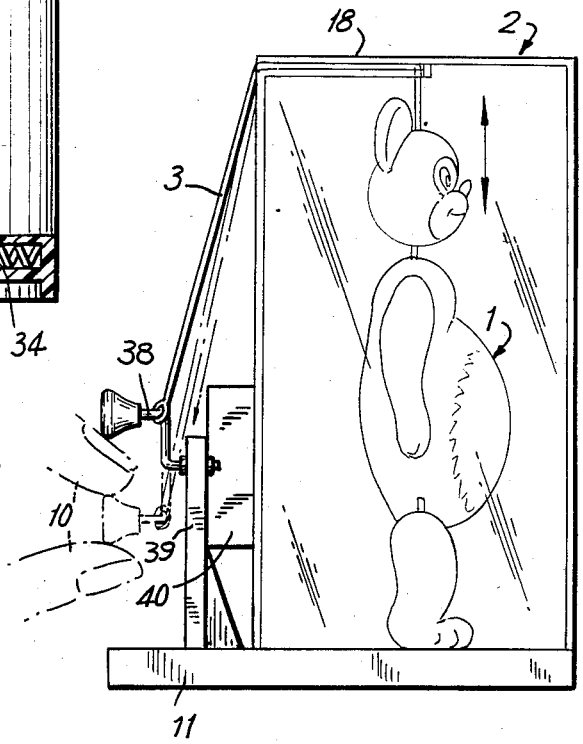
FIG. 5 is a view similar to that of FIG. 4 but showing a further modification of the construction of the confined animation figure toy according to the present invention.

FIG. 5 shows another modification wherein the same reference numerals as before have again been utilized to identify corresponding parts. In this case, the housing 2 is again of a generally box-shaped configuration as in FIGS. 1 to 3. However, this time the end of the string 3 which is remote from the figure 1 is attached to a crank 38 which is mounted on a support 39 that is rigid with the bottom wall 11 for rotation about a substantially horizontal axis. The cranking motion of the crank 38 by the fingers 10 of the user results in periodic shortening and lengthening of the effective length of the string 3, with resulting movement of the figure 1. Of course, the actual length of the string 3 remains the same, unless the same is made of an elastic material, but the cranking motion of the crank 38 results in an up-and-down (and side-to-side) movement of the string 3 the same as if the length of the string were in effect changed. Advantageously, the crank 38 also drives a music box 40 which then provides musical accompaniment to the dancing movements of the toy figure 1.

Figure 6:
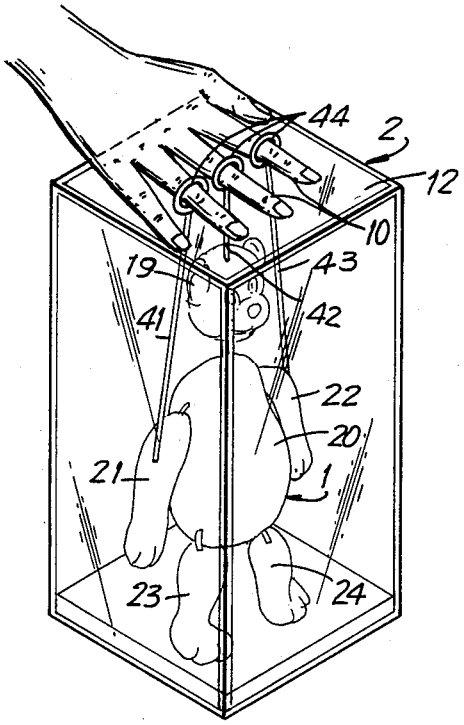
FIG. 6 is a perspective view of a further modified construction of the confined animation figure toy as proposed by the present invention.

Finally, in FIG. 6 there is shown another modification also using the same reference numerals as before to denote corresponding parts. Here, the top wall 12 has three apertures (not shown in the drawing since they are obscured by the fingers 10 of the user) through which there respectively pass actuating rods 41, 42 and 43 each of which is provided at its end situated at the exterior of the housing 2 with a finger-receiving eyelet 44. The ends of the actuating rods 41, 42 and 43 which are remote from the eyelets 44 are connected, respectively, to the front leg 21, to the head 19, and to the other front leg 22. Thus, the user can introduce his or her fingers 10 into the respective eyelets 44 and manipulate the toy figure 1 to simulate dancing movements by selectively lifting one or more of the fingers 10 and/or lowering the same from their raised positions. Advantageously, the actuating rods 41, 42 and 43 are transparent to conceal their existance, as may be the string 3 discussed above. Moreover, instead of actuating rods, one can also use actuating strings as the actuating elements 41, 42 and 43.

It will be understood that each of the elements described above, or two or more together, may also find a useful application in other types of arrangements differing from the type described above.

While the invention has been illustrated and described as embodied in a confined animation figure toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A closely confined animation toy comprising:

a housing including a plurality of walls collectively bounding an internal chamber, at least a part of at least one of said walls being transparent to enable a user of said toy to observe the interior of said housing and its contents;

an elongated operating element mounted on said housing for movement and having a flexible suspension portion extending into said internal chamber through a top one of said walls as considered in the position of use of the toy and an actuation portion located exteriorly of said housing; and an animation figure accommodated in said internal chamber of said housing and having a plurality of connected parts displaceable with respect to one another, said parts including a torso, a head above and connected to the torso by a flexible elongated connector, and a plurality of limbs being connected to said torso by additional flexible elongated connectors, said figure being suspended from said suspension portion of said operating element for movement in response to the movement of the latter between a rest position in which said figure assumes a substantially erect position and a plurality of animated positions with attendant displacement of said parts with respect to one another to simulate voluntary body movements, the improvement comprising:

said suspension portion being constructed as a single flexible element connected to said head of said figure wherein a movement of said elongated operating element imparts a direct movement to said head, said walls of said housing being located in a close confronting adjacent relationship with said figure whereby a movement of said figure will result in said parts thereof randomly striking said walls, said striking of said walls thus operating to impart additional random movement to said figure which would not otherwise be accomplished due to the fact that no additional flexible operating elements are employed to move the limbs thereof, all such movement realized by asid figure thus being imparted thereto by a movement of the suspension element attached to said head and the striking of the parts of said figure against said walls.

* * * * *